US010544768B2

(12) United States Patent
Kashiwagi

(10) Patent No.: US 10,544,768 B2
(45) Date of Patent: Jan. 28, 2020

(54) PULSATION DAMPER AND FUEL PUMP DEVICE

(71) Applicant: DENSO CORPORATION, Kariya, Aichi-pref. (JP)

(72) Inventor: Daisuke Kashiwagi, Kariya (JP)

(73) Assignee: DENSO CORPORATION, Kariya (JP)

( * ) Notice: Subject to any disclaimer, the term of this patent is extended or adjusted under 35 U.S.C. 154(b) by 29 days.

(21) Appl. No.: 15/915,197

(22) Filed: Mar. 8, 2018

(65) Prior Publication Data

US 2018/0328328 A1 Nov. 15, 2018

(30) Foreign Application Priority Data

May 11, 2017 (JP) ..... 2017-95009

(51) Int. Cl.

| | |
|---|---|
| ***F02M 55/04*** | (2006.01) |
| ***F02M 59/46*** | (2006.01) |
| ***F02M 55/00*** | (2006.01) |
| ***F02M 59/02*** | (2006.01) |
| ***F04B 53/00*** | (2006.01) |
| ***F04B 11/00*** | (2006.01) |
| ***F02M 59/10*** | (2006.01) |
| ***F02M 59/44*** | (2006.01) |

(52) U.S. Cl.

CPC ..... *F02M 55/04* (2013.01); *F02M 55/005* (2013.01); *F02M 59/02* (2013.01); *F02M 59/102* (2013.01); *F02M 59/44* (2013.01); *F02M 59/46* (2013.01); *F04B 11/0016* (2013.01); *F04B 53/001* (2013.01); *F02M 2200/315* (2013.01)

(58) Field of Classification Search

CPC ..... F02M 55/04; F02M 55/005; F02M 59/02; F02M 59/102; F02M 59/44; F02M 59/46; F02M 2200/315; F04B 11/0016; F04B 53/001

USPC ..... 123/495; 417/540

See application file for complete search history.

(56) References Cited

U.S. PATENT DOCUMENTS

| | | | | |
|---|---|---|---|---|
| 7,124,738 | B2 | 10/2006 | Usui et al. | |
| 8,366,421 | B2 * | 2/2013 | Munakata | F02M 55/04 123/510 |
| 8,430,081 | B2 * | 4/2013 | Mancini | F02M 59/462 123/446 |
| 2003/0164161 | A1 | 9/2003 | Usui et al. | |
| 2007/0107698 | A1 | 5/2007 | Usui et al. | |
| 2010/0163004 | A1 * | 7/2010 | Kurata | F02D 41/406 123/491 |

(Continued)

FOREIGN PATENT DOCUMENTS

| | | | |
|---|---|---|---|
| EP | 1671031 | B1 | 9/2004 |

*Primary Examiner* — Mahmoud Gimie

(57) ABSTRACT

A pulsation damper for a fuel pump having a pump body in which a fuel passage is defined includes: a diaphragm that is elastically deformed in a predetermined direction by receiving a pressure of fuel; a casing part including a housing chamber that houses the diaphragm; and an attachment to be attached to the pump body. The attachment includes a communication passage that makes the housing chamber to communicate with the fuel passage. The attachment has a length in a perpendicular direction perpendicular to the predetermined direction, and the length of the attachment is smaller than a length of the casing part in the perpendicular direction.

12 Claims, 4 Drawing Sheets

(56) References Cited

U.S. PATENT DOCUMENTS

| | | | | |
|---|---|---|---|---|
| 2012/0006303 | A1* | 1/2012 | Usui | F02M 55/04 123/495 |
| 2013/0052064 | A1 | 2/2013 | Oikawa et al. | |
| 2017/0023165 | A1* | 1/2017 | Fujita | F04B 39/0033 |

* cited by examiner

PULSATION DAMPER AND FUEL PUMP DEVICE

CROSS REFERENCE TO RELATED APPLICATION

This application is based on Japanese Patent Application No. 2017-95009 filed on May 11, 2017, the disclosure of which is incorporated herein by reference in its entirety.

TECHNICAL FIELD

The present disclosure relates to a pulsation damper and a fuel pump device.

BACKGROUND

A fuel pump includes a pump body in which a fuel passage is defined, and compresses and discharges fuel flowing in the fuel passage. In the fuel pump, pressure pulsation of fuel causes noise, and wearing or breakage in the piping components. JP 2013-60945A describes a pulsation damper which reduces pressure pulsation of fuel for a fuel pump.

Specifically, the pump body has a concave portion recessed from the outer surface, and the fuel flowing through the fuel passage flows into the concave portion. An opening of the concave portion is covered with a cover to tightly seal, such that a housing chamber is formed inside. A diaphragm is arranged in the housing chamber, and is elastically deformed by receiving the pressure of fuel so as to reduce the pressure pulsation of fuel.

SUMMARY

However, the size of the pump body is increased, since it requires forming the housing chamber large enough for housing the diaphragm of the pulsation damper.

It is an object of the present disclosure to provide a pulsation damper and a fuel pump device in which pressure pulsation of fuel can be reduced and a size of a pump body is restricted from becoming large.

According to an aspect of the present disclosure, a pulsation damper to reduce pressure pulsation of fuel for a fuel pump having a pump body in which a fuel passage is defined and compressing and discharging fuel flowing in the fuel passage, the pulsation damper includes:

a diaphragm that is elastically deformed in a predetermined direction by receiving a pressure of fuel;

a casing part including a housing chamber that houses the diaphragm; and an attachment to be attached to the pump body, the attachment including a communication passage that makes the housing chamber to communicate with the fuel passage.

The attachment has a length in a perpendicular direction perpendicular to the predetermined direction, and the length of the attachment is smaller than a length of the casing part in the perpendicular direction.

According to an aspect of the present disclosure, a fuel pump device includes: a fuel pump having a pump body in which a fuel passage is defined and compressing and discharging fuel which flows in the fuel passage; and a pulsation damper attached to the pump body to reduce pressure pulsation of fuel. The pulsation damper includes a diaphragm that is elastically deformed in a predetermined direction by receiving a pressure of fuel, a casing part including a housing chamber that houses the diaphragm, and an attachment attached to the pump body and including a communication passage that makes the fuel passage and the housing chamber to communicate with each other.

The attachment has a length in a perpendicular direction perpendicular to the predetermined direction, and the length of the attachment is smaller than a length of the casing part in the perpendicular direction.

Accordingly, the housing chamber is formed in the casing part which is a component different from the pump body. Therefore, it can make it unnecessary to form the housing chamber dimensioned to house the diaphragm in the pump body although it is required to form a damper attachment in the pump body, to which the attachment of the pulsation damper is attached. Since the length of the attachment in the perpendicular direction perpendicular to the predetermined direction in which the diaphragm is elastically deformed is smaller than the length of the casing part in the perpendicular direction, the damper attachment can be made smaller than the diaphragm. Therefore, the size of the pump body is restricted from becoming large, compared with a case where a housing chamber is formed in a pump body.

In short, according to the present disclosure, the housing chamber is formed outside of the pump body, such that the size of the pump body is restricted from becoming large while pressure pulsation of fuel can be reduced by the pulsation damper.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
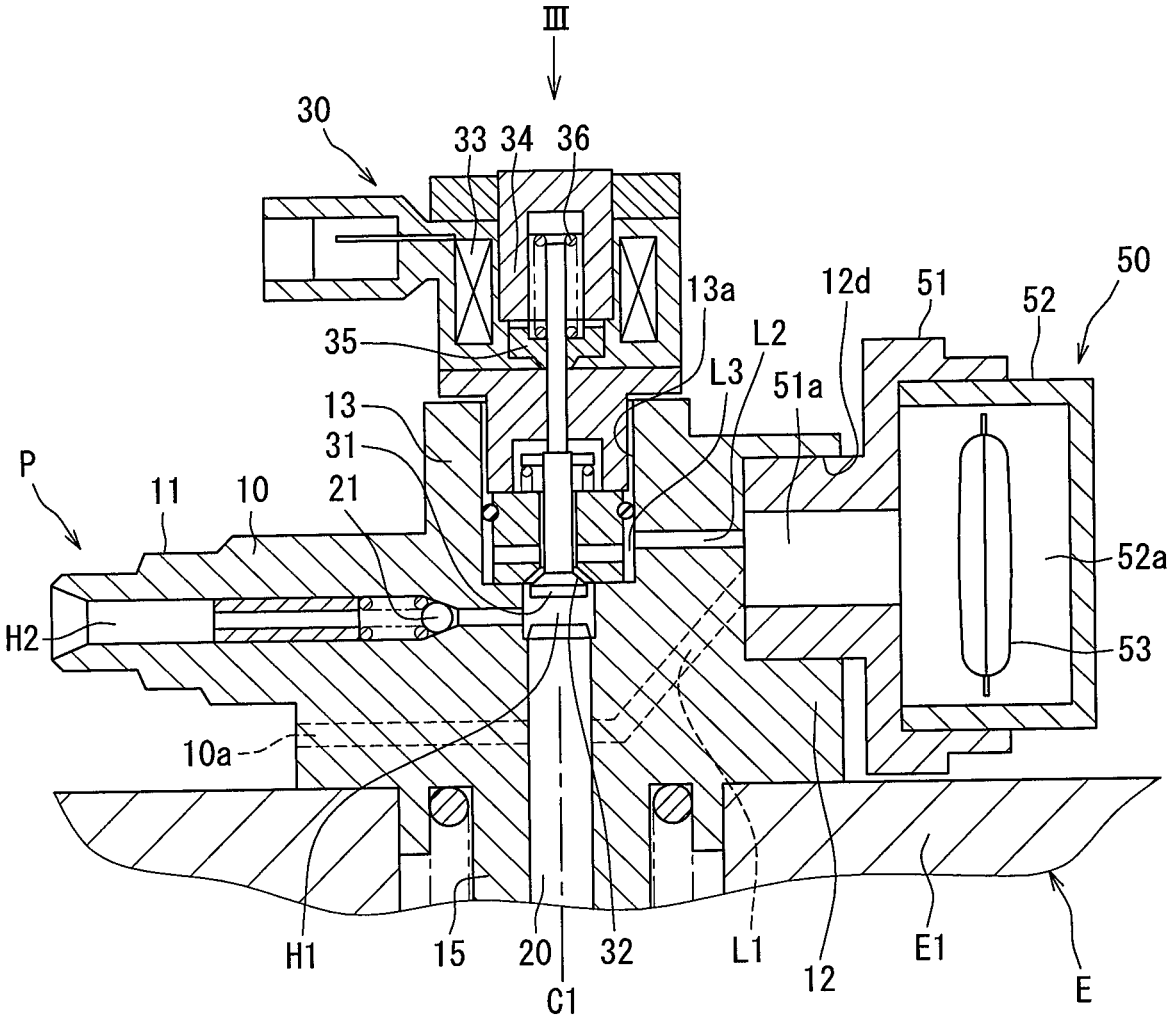
FIG. 1 is a sectional view illustrating a fuel pump device according to a first embodiment that is set to an engine.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A fuel pump device shown in FIG. 1 is applied to an internal-combustion engine (engine E) for a vehicle, and includes a fuel pump P and a pulsation damper 50. The fuel pump P compresses and discharges fuel for the engine E. The engine E is a compression self-ignition type, and the fuel compressed and discharged by the fuel pump device is light oil. The fuel pump P has a pump body 10, a piston 20, and a control valve unit 30. The pulsation damper 50 is attached to the pump body 10.

A fuel passage 10*a* is formed inside of the pump body 10. The fuel passage 10*a* includes a first low-pressure passage L1, a second low-pressure passage L2, a third low-pressure passage L3, a compression chamber H1, and a high-pressure passage H2. Fuel which flows into the fuel pump P from a fuel tank (not shown) flows through the first low-pressure passage L1, the second low-pressure passage L2, the pulsation damper 50, and the third low-pressure passage L3 in this order, and flows into the compression chamber H1 to be compressed by the piston 20. The high-pressure fuel compressed by the piston 20 is discharged out of the high-pressure passage H2, and is supplied to a common-rail (not shown). The high-pressure fuel supplied to the common-rail is injected from a fuel injection valve to the combustion chamber of the engine E.

Figure 3:
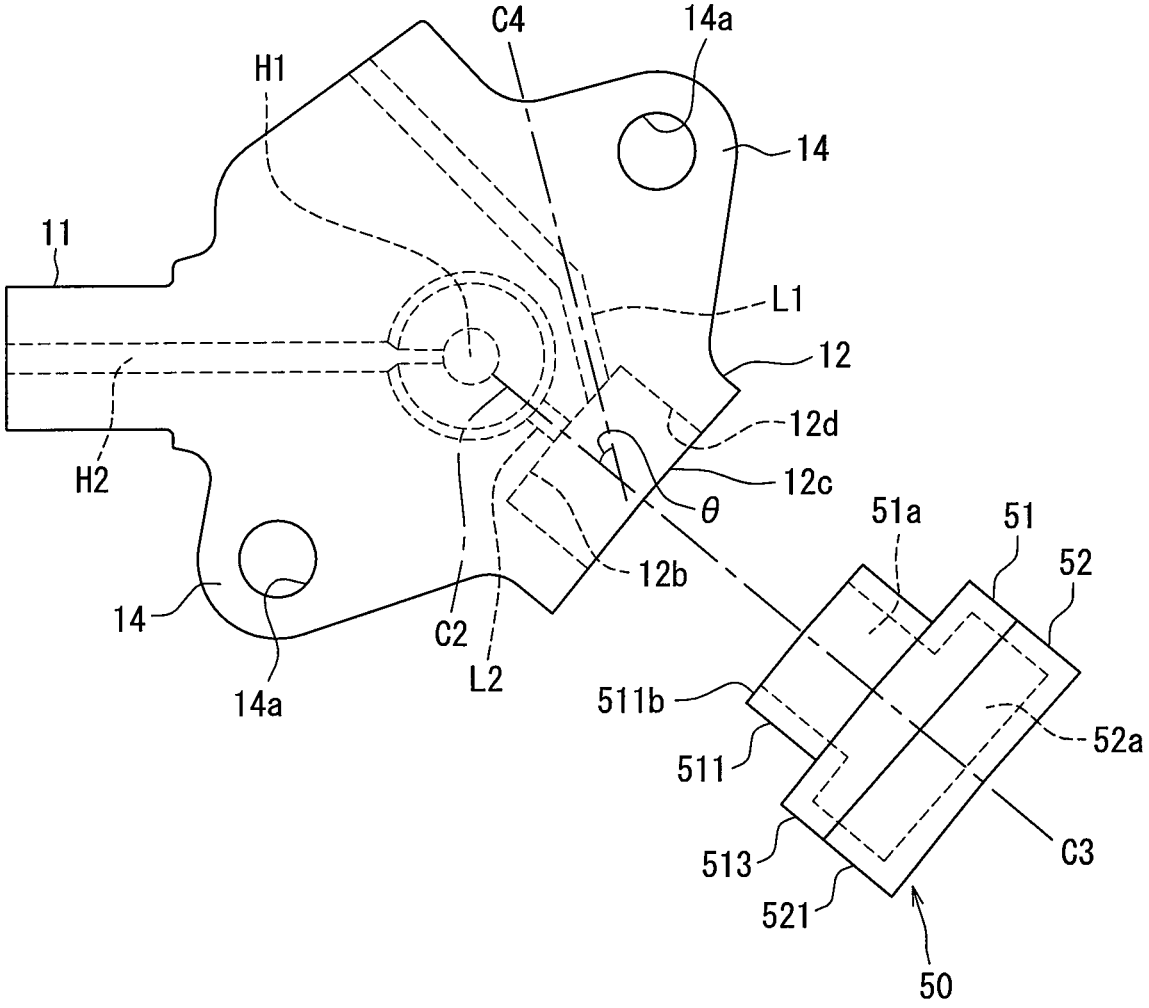
FIG. 3 is an exploded view illustrating the pulsation damper that is removed from the fuel pump, in view of an arrow direction III of FIG. 1.

The pump body 10 is made of metal and formed by, for example, punching holes in a forged product (not shown). The pump body 10 has a high-pressure port 11, a damper attachment 12, a control valve attachment 13, a flange 14 (refer to FIG. 3), and a cylinder 15.

The high-pressure passage H2 is defined in the high-pressure port 11, and a high-pressure piping (not shown) is connected to the high-pressure port 11. A pressure valve 21 is attached in the high-pressure passage H2. When a pressure of fuel pressurized in the compression chamber H1 becomes more than or equal to a predetermined pressure, the pressure valve 21 opens and high-pressure fuel is discharged from the high-pressure port 11. The high-pressure port 11 is formed to extend in a direction perpendicular to the axial direction of the piston 20. The axial direction represents a both-way reciprocating direction of the piston 20, that is along the axis C1 of the piston 20.

The control valve attachment 13 is projected in the direction perpendicular to the axial direction of the piston 20. An attachment hole 13*a* is formed inside of the control valve attachment 13, and the control valve unit 30 is attached into the attachment hole 13*a*.

The control valve unit 30 has a control valve 31, an electromagnetic coil 33, a fixed core 34, a movable core 35, and a spring 36. The control valve 31 controls the quantity of fuel to be compressed by opening and closing an inflow port 32 of the compression chamber H1. The control valve 31 is attached to the control valve unit 30 in the state where the control valve 31 is able to move in both-way. The control valve unit 30 is attached to the control valve attachment 13 in a manner that the reciprocation direction of the control valve 31, that is, the axis of the control valve 31 agrees with the axis C1 of the piston 20.

When the electromagnetic coil 33 is energized, magnetic flux arises to the fixed core 34 and the movable core 35. The fixed core 34 and the movable core 35 form a magnetic circuit, and the movable core 35 is attracted to the fixed core 34 by the magnetic force. The movable core 35 attracted in this way moves with the control valve 31, and the spring 36 biases the movable core 35 and the control valve 31 in a direction different from the magnetic force. Therefore, when the electromagnetic coil 33 is energized, the movable core 35 and the control valve 31 move to one side by the magnetic force against the elastic force. When the energizing of the electromagnetic coil 33 is stopped, the movable core 35 and the control valve 31 move to the other side due to the elastic force. Specifically, the control valve 31 is a normally-open type valve which is closed by the energizing. The control valve 31 is opened by stopping the energizing. The energizing to the electromagnetic coil 33 is controlled by a control device (not shown).

A bolt (not shown) is inserted in a bolt hole 14*a* (refer to FIG. 3) of the flange 14, and is fixed at a predetermined part of the engine E, such that the fuel pump device is assembled to the predetermined part of the engine E. For example, the fuel pump device is attached to a crankcase E1 that houses and supports a crankshaft of the engine E. In this state, the driving force of the engine E is transmitted to the piston 20 through a cam (not shown), and the piston 20 reciprocates inside of the cylinder 15 while the engine E is operated.

The damper attachment 12 is projected in the direction perpendicular to the axial direction of the piston 20. An attachment hole 12*d* is formed inside of the damper attachment 12, and the pulsation damper 50 is attached into the attachment hole 12*d*. The central line C2 (refer to FIG. 3) of the attachment hole 12*d* crosses the axis C1 of the piston 20, specifically, intersects perpendicularly to the axis C1 of the piston 20. The end of the first low-pressure passage L1 and the end of the second low-pressure passage L2 are open to the attachment hole 12*d*. The central line C2 of the attachment hole 12*d* is in agreement with the central line of the second low-pressure passage L2. The angle θ defined by the intersection between the central line C4 (refer to FIG. 3) of the first low-pressure passage L1 and the central line C2 of the second low-pressure passage L2 is an acute angle. The central lines C2 and C4 cross with each other inside of the attachment hole 12*d*.

The pulsation damper 50 includes an attachment component 51 attached to the damper attachment 12, a cover component 52 which forms the housing chamber 52*a* with the attachment component 51, and a diaphragm 53 arranged in the housing chamber 52*a*.

The attachment component 51 has an attachment 511, an attachment bottom 512, and an attachment cylinder part 513, and is made of metal different from the pump body 10. The attachment component 51 is made of a material (for example, stainless steel) having a strength lower than that of the damper attachment 12 and excellent in welding operation compared with the damper attachment 12. The pump body 10 is made of a material (for example, carbon steel) excellent in forging fabrication.

The attachment 511 has a cylinder shape inserted in the attachment hole 12*d*. The cylindrical inside space of the attachment 511 functions as a communication passage 51*a* making the fuel passage 10*a* and the housing chamber 52*a* to communicate with each other. The fuel passage 10*a* to be communicated with the communication passage 51*a* is the first low-pressure passage L1 and the second low-pressure passage L2.

A damper side screw part 511*a* is formed around the outer circumference (the external pipe surface) of the attachment 511. The damper side screw part 511*a* is engaged with a body side screw part 12*a* formed around the inner circumference of the attachment hole 12*d*. Due to the engagement, the attachment end surface 511*b* which is an end surface (the end surface of the pipe form) of the attachment 511 is in contact and pressed against a contact surface 12*b* of a bottom of the attachment hole 12*d* of the damper attachment 12. The contact surface 12*b* has an annular shape surrounding the communication passage 51*a*.

Water which exists outside of the pulsation damper 50 may enter the pulsation damper 50 from the opening 12*c* of the attachment hole 12*d* through a contact portion between the damper attachment 12 and the attachment component 51. The contact portion may represent the damper side screw part 511*a* and the attachment end surface 511*b*. A clearance between the damper attachment 12 and the attachment component 51, and the contact portion are called as a permeation course. Then, a seal component 12*r* is arranged between the outer circumference of the attachment 511 and the inner circumference of the attachment hole 12*d*, to seal a space between the damper attachment 12 and the attachment components 51. The seal component 12*r* is arranged upstream of the damper side screw part 511*a* in the permeation course.

The attachment bottom 512 has a disk form extending in a radial direction from the end surface of the attachment 511 opposite from the attachment end surface 511*b*. The attachment cylinder part 513 has a cylinder shape extending from the outer circumference end of the attachment bottom 512 in the direction parallel to the central line C3 (refer to FIG. 3) of the communication passage 51*a*. The opening 513*c* of the attachment cylinder part 513 is covered with the cover component 52.

The cover component 52 has a cover cylinder part 521 and a cover bottom 522, and is made of metal the same as the attachment component 51. The cover cylinder part 521 has a cylindrical shape, and is inserted inside the attachment cylinder part 513, such that the outer circumference surface 521*a* (the external pipe surface) of the cover cylinder part 521 is in contact with the inner circumference surface 513*a* (the inner pipe surface) of the attachment cylinder part 513. The attachment cylinder part 513 and the cover cylinder part 521 are combined with each other by welding. The cylinder end surface 521*b* (the end surface of the pipe form) of the cover cylinder part 521 is in contact with the contact surface 512*a* of the attachment bottom 512. The contact surface 512*a* has an annular shape surrounding the opening 513*c*.

The attachment component 51 and the cover component 52 are welded, thereby a portion surrounded by the cover bottom 522, the cover cylinder part 521, and the attachment bottom 512 functions as the housing chamber 52*a* which houses the diaphragm 53. Therefore, of the attachment component 51 and the cover component 52, the cover bottom 522, the cover cylinder part 521, and the attachment bottom 512 correspond to a casing part which forms the housing chamber 52*a*. The housing chamber 52*a* is filled with low-pressure fuel which flows from the communication passage 51*a*.

The diaphragm 53 has a first elastic board 531 and a second elastic board 532 shaped in disc. The outer circumference portions of the elastic boards 531 and 532 function as flange parts 531*a* and 532*a* joined with each other by welding. Both the flange parts 531*a* and 532*a* are in tight contact with each other, and tightly seals the interior space surrounded by the elastic boards 531 and 532. The interior space is filled with high-pressure gas having a pressure higher than atmospheric pressure. The central line of the disk-shaped elastic boards 531 and 532 is in agreement with the central line C3 of the communication passage 51*a*. The elastic boards 531 and 532 are elastically deformed in a predetermined direction corresponding to the central line C3 by receiving the pressure of fuel which flows into the housing chamber 52*a*. Thus, the diaphragm 53 is elastically deformed, according to the pressure of fuel, to absorb and decrease the pulsation of fuel pressure.

A support object (not shown) is arranged in the housing chamber 52*a*. The support object is fixed to the casing part and supports the diaphragm 53. The diaphragm 53 is supported by the support object in the state where the elastic deformation is possible.

In short, the pulsation damper 50 is a unit where the attachment component 51 and the cover component 52 are welded and the diaphragm 53 is housed inside. The unit of the pulsation damper 50 is attached to the attachment hole 12*d* of the pump body 10 by a fastening member.

Next, dimensional relations are explained with reference to FIG. 2. In the following explanation, the diaphragm 53 is defined to be elastically deformed in a predetermined direction (the left and right direction of FIG. 2), and a direction perpendicular to the predetermined direction is called as a perpendicular direction.

The length of the attachment 511 of the attachment component 51 in the perpendicular direction, that is, the outer diameter D1 of the attachment 511 is smaller than the length of the casing part in the perpendicular direction, that is, the outer diameter D4 of the cover cylinder part 521. The diameter D1 of the attachment 511 is strictly a diameter of the outer circumference surface of the cylindrical attachment 511, in other words, the diameter D1 of the damper side screw part 511*a*. The diameter D2 of the attachment 511 is strictly a diameter D2 of the inner circumference surface of the cylindrical attachment 511. The diameters D1 and D2 of the attachment 511 are smaller than the diameter D3 of the diaphragm 53.

The diameter of the communication passage 51*a* is larger than the diameter of a portion of the fuel passages 10*a* adjacent to the communication passage 51*a*. Specifically, the diameter of the communication passage 51*a* is larger than the diameter of the first low-pressure passage L1 and the second low-pressure passage L2 communicated with the communication passage 51*a*.

Next, the operation of the fuel pump P is explained.

The control device (not shown) controls the electric power supply to the electromagnetic coil 33, and opens the control valve 31 in the period in which the piston 20 descends. Thereby, the low-pressure fuel flowing through the first low-pressure passage L1, the communication passage 51*a*, the second low-pressure passage L2, and the third low-pressure passage L3 in this order is drawn from the inflow port 32 to the compression chamber H1.

Then, the control device opens the control valve 31 until a desired control period passes after the piston 20 starts rising. Thereby, in the control period in which the flow rate is controlled, the low-pressure fuel of the compression chamber H1 flows out of the inflow port 32, and is put back toward the third low-pressure passage L3, the second low-pressure passage L2, the communication passage 51*a*, and the first low-pressure passage L1. Thus, the pressure of the fuel put back in this way is rippled. This pressure pulsation is spread in order of the fuel of the third low-pressure passage L3, the fuel of the second low-pressure passage L2, the fuel of the communication passage 51*a*, and the fuel of the housing chamber 52*a*. The pulsation in the fuel pressure spread to the fuel of the housing chamber 52*a* is absorbed by the diaphragm 53, and is reduced. Thereby, the noise and the breakage and the wearing in the piping parts, which are caused by the fuel pressure pulsation, can be reduced.

Then, the control device closes the control valve 31 in the rising phase (compression period) of the piston 20 after the control period passed. Thereby, in the compression period, the fuel of the compression chamber H1 is pressurized, and the pressure becomes high. When the pressure becomes more than or equal to a predetermined pressure, the pressure valve 21 is opened and the high-pressure fuel is breathed out from the high-pressure passage H2. Therefore, the control period is controlled by controlling the valve closing timing of the control valve 31, such that the quantity of the fuel compressed in the compression period is controlled.

As explained above, the pulsation damper 50 of this embodiment is produced as a unit separated from the pump body 10. Specifically, the pulsation damper 50 includes the diaphragm 53, the casing part including the housing chamber 52*a* which houses the diaphragm 53, and the attachment 511 attached to the pump body 10. The attachment 511 includes the communication passage 51*a* which makes the fuel passage 10*a* formed in the pump body 10 to communicate with the housing chamber 52*a*. Therefore, it is unnecessary to form a housing chamber in the pump body 10, although it is necessary to form the attachment hole 12*d* (damper attachment) to which the attachment 511 is attached.

Since the length of the attachment 511 in the perpendicular direction perpendicular to the direction in which the diaphragm 53 is elastically deformed is set smaller than the length of the casing part in the perpendicular direction, the diameter D1, D2 of the attachment hole 12*d* (damper attachment) can be made smaller than the diameter D4 of the housing chamber 52*a*. Therefore, the size of the pump body 10 can be restricted from becoming large, compared with the case where a housing chamber is formed in the pump body 10. According to the present embodiment, since the pump body 10 is fabricated by the forging, the waste part, which is generated in the forged product by forming the housing chamber in the pump body 10, can be reduced.

In other words, the attachment component 51 of the pulsation damper 50 operates as an adapter which reduces the diameter D4 of the housing chamber 52*a* to the diameter of the communication passage 51*a* smaller than the diameter D4. Since the diameter-reduced attachment 511 of the attachment component 51 is attached to the pump body 10, the attachment hole 12*d* (damper attachment) of the pump body 10 can be made smaller, compared with a case where the casing part, which is not reduced in the diameter, is attached to the pump body 10.

Furthermore, since the pulsation damper 50 is produced as a unit separately from the pump body 10, the attachment 511 and the pump body 10 can be made of metals different from each other. Therefore, the pump body 10 can be made of a material (for example, carbon steel) advantageous to resisting pressure, and the attachment component 51 which has the attachment 511 can be made of a material (for example, SUS) advantageous for welding with the cover component 52.

If water adheres to the contact portion between the metals different from each other, metal corrosion may be generated in the contact portion. In view of this point, the pulsation damper 50 of this embodiment includes the seal component 12*r* which seals the space between the pump body 10 and the attachments 511. The seal component 12*r* is arranged upstream of the damper side screw part 511*a* (contact portion) in the permeation course of the water from the outside of the attachment 511. Therefore, the seal component 12*r* can control the water infiltration into the contact portion between the metals different from each other, i.e., the damper side screw part 511*a* and the body side screw part 12*a*, such that the corrosion can be restricted at the contact portion between the metals different from each other.

Furthermore, in this embodiment, the casing part has the first casing part and the second casing part. The first casing part has the pipe form in which the opening 513*c* is defined to insert the diaphragm 53 in the housing chamber 52*a*, and is provided by the attachment bottom 512 and the attachment cylinder part 513. The second casing part has a based pipe form which covers the opening 513*c*, and is provided by the cover cylinder part 521. The inner pipe surface of one of the first casing part and the second casing part is combined with the external pipe surface of the other of the first casing part and the second casing part, and the end surface of the one of the first casing part and the second casing part is in contact with the other of the first casing part and the second casing part.

Specifically, the cylindrical inner circumference surface 513*a* (the inner pipe surface) of the attachment cylinder part 513 (one casing part) is combined with the cylindrical outer circumference surface 521*a* (the external pipe surface) of the cover cylinder part 521 (the other casing part) by welding. Moreover, the end surface 521*b* of the cover cylinder part 521 is in contact with the contact surface 512*a* of the attachment bottom 512. Thereby, a foreign substance produced when, for example, assembling the attachment cylinder part 513 is restricted from entering the housing chamber 52*a* by sealing with the contact surface 512*a*.

Furthermore, in this embodiment, the damper side screw part 511*a* (the external pipe surface) of the attachment 511 is combined with the pump body 10, and the attachment end surface 511*b* (the end surface) of the attachment 511 is in contact with the pump body 10. Thereby, a foreign substance produced in the combining such as burr produced when tightening a screw is restricted from entering the communication passage 51*a* by sealing with the attachment end surface 511*b*.

Furthermore, in this embodiment, the diameter D2 of the communication passage 51*a* is larger than the diameter of a portion of the fuel passages 10*a* adjacent to the communication passage 51*a*, i.e., the diameter of the first low-pressure passage L1 and the second low-pressure passage L2. Thereby, the pressure pulsation of fuel is easily transmitted to the diaphragm 53 by the large-diameter passage (communication passage 51*a*), compared with a case where the fuel passage 10*a* with the small diameter, i.e., the first low-pressure passage L1 and the second low-pressure passage L2, is directly communicated with the housing chamber 52*a*. Therefore, the effect of reducing the pressure pulsation can be raised.

Furthermore, according to the fuel pump device of this embodiment, the control valve 31 of the fuel pump P is arranged on the axis C1 of the piston 20, such that the volume of the high-pressure fuel which remains after fuel discharge can be decreased, compared with a case where the control valve 31 is arranged to cross the axis C1. In recent years, there is a tendency that the pressure is raised in the fuel pump P. As the pressure in the compression chamber H1 is higher, it is required to reduce the loss by decreasing the volume. Therefore, according to this embodiment, in which the control valve 31 is arranged on the axis C1 of the piston 20, the volume can be made smaller to reduce the loss.

However, when the control valve 31 is arranged right above the piston 20 in this way, it becomes difficult to arrange the pulsation damper 50 right above the piston 20, such that the pulsation damper 50 is arranged to the side of the piston 20. It is difficult to secure the housing chamber 52*a* housing the diaphragm 53 inside of the damper attachment 12, since a portion of the pump body 10 on the side of the piston 20 is located near the attachment portion such as the crankcase E1 of the engine E.

According to the present embodiment, the pulsation damper 50 is produced as a unit while the control valve 31 is arranged right above the piston 20 in the fuel pump P. Therefore, the pulsation damper 50 can be arranged in a manner that the predetermined direction in which the diaphragm 53 is elastically deformed crosses the axis C1 of the piston 20. Accordingly, the effect that "the pump body 10 can be restricted from becoming large" by producing the pulsation damper 50 as a unit becomes more effective.

(Second Embodiment)

Figure 4:
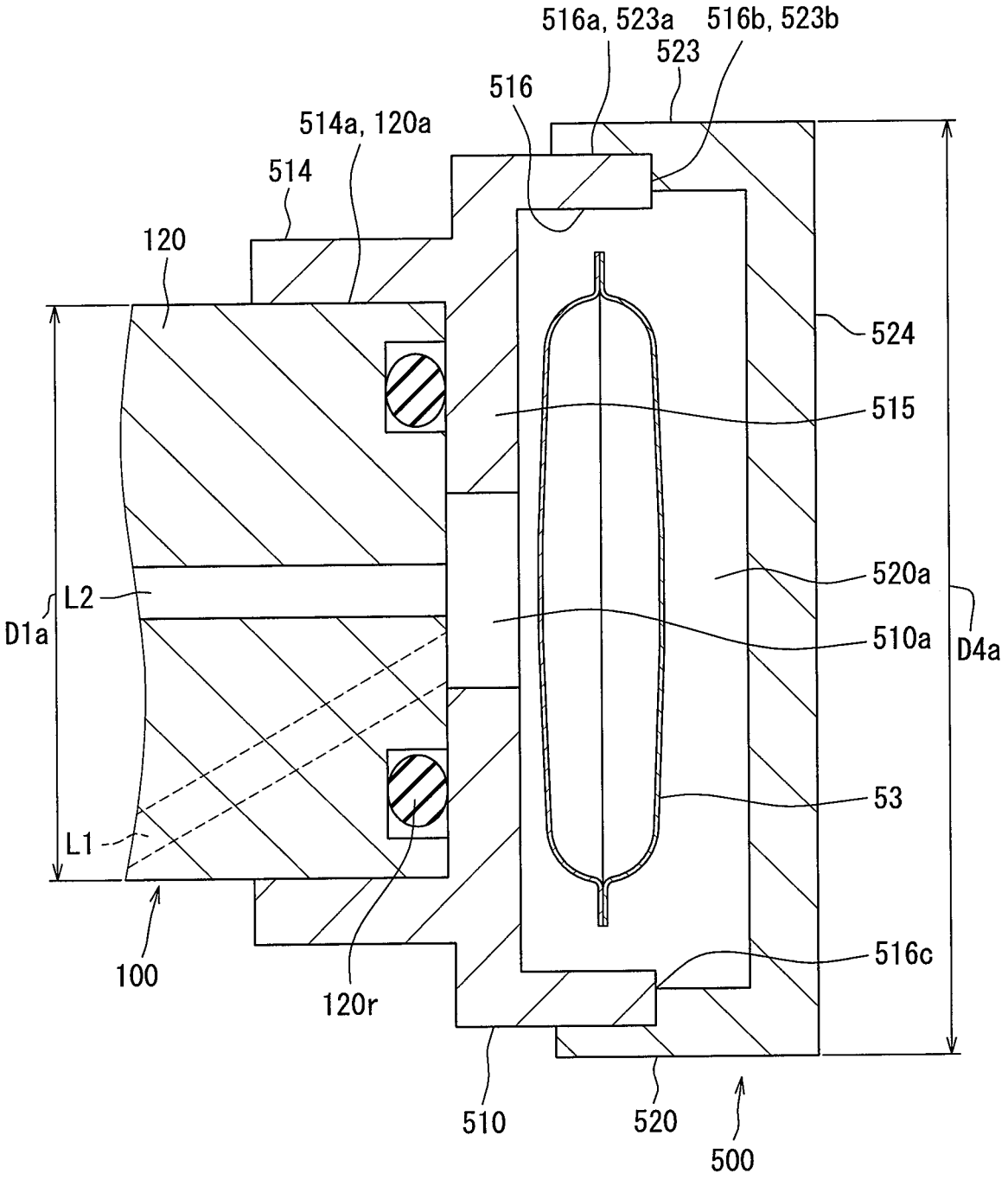
FIG. 4 is a sectional view illustrating a fuel pump device according to a second embodiment.

In the first embodiment, when attaching the attachment component 51 to the damper attachment 12 of the pump body 10, the attachment component 51 is inserted in the attachment hole 12*d* formed in the damper attachment 12. In contrast, in this embodiment, as shown in FIG. 4, when attaching the attachment component 510 to the damper attachment 120 of the pump body 100, the damper attachment 120 is inserted in the attachment component 510.

Specifically, the attachment component 510 of this embodiment has the attachment screw part 514, the attachment bottom 515, and the attachment cylinder part 516. The attachment screw part 514 and the attachment bottom 515 correspond to an attachment to be attached to the pump body 100. The communication passage 510*a* is defined in the attachment to make the fuel passage 10*a* and the housing chamber 520*a* to communicate with each other.

The attachment screw part 514 has a cylinder shape into which the damper attachment 120 is inserted. The damper side screw part 514*a* is formed around the inner circumference surface (the inner pipe surface) of the attachment screw part 514. The damper side screw part 514*a* is engaged with the body side screw part 120*a* formed around the outer circumference of the damper attachment 120.

The attachment bottom 515 has a disk form extending in the radial direction from the end surface of the attachment screw part 514. The communication passage 510*a* which communicates the fuel passage 10*a* and the housing chamber 52*a* with each other is formed in the attachment bottom 515. The fuel passage 10*a* to be communicated with the communication passage 510*a* is the first low-pressure passage L1 and the second low-pressure passage L2. The seal component 120*r* is arranged between the attachment bottom 515 and the damper attachment 120.

The attachment cylinder part 516 has a cylinder shape extending in a direction parallel to the central line C3 of the communication passage 51*a* from the outer circumference of the attachment bottom 515. The opening 516*c* of the attachment cylinder part 516 is covered with the cover component 520.

The cover component 520 has the cover cylinder part 523 and the cover bottom 524, and is made of metal the same as the attachment component 510. The cover cylinder part 523 has a cylinder shape, and is arranged outside of the attachment cylinder part 516 in a manner that the inner circumference surface 523*a* (the inner pipe surface) of the cover cylinder part 523 is in contact with the outer circumference surface 516*a* (the external pipe surface) of the attachment cylinder part 516. The attachment cylinder part 516 and the cover cylinder part 523 are combined by welding. The end surface 516*b* (the end surface) of the attachment cylinder part 516 is in contact with the contact surface 523*b* of the cover cylinder part 523. The contact surface 523*b* has an annular shape surrounding the opening 516*c*.

The attachment component 510 and the cover component 520 are welded, thereby a portion surrounded by the attachment bottom 515, the attachment cylinder part 516, the cover cylinder part 523, and the cover bottom 524 functions as the housing chamber 520*a* housing the diaphragm 53. Therefore, the attachment bottom 515, the attachment cylinder part 516, the cover cylinder part 523, and the cover bottom 524 correspond to a casing part which forms the housing chamber 520*a*. The housing chamber 520*a* is filled with the low-pressure fuel which flows from the communication passage 510*a*.

The casing part has the first casing part shaped in a pipe form in which the opening 516*c* is defined, through which the diaphragm 53 is inserted in the housing chamber 520*a*. The attachment cylinder part 516 may correspond to the first casing part. The casing part has the second casing part shaped in a based pipe form which covers the opening 516*c*, and the cover cylinder part 523 may correspond to the second casing part. The inner pipe surface of one of the first casing part and the second casing part is combined with the external pipe surface of the other of the first casing part and the second casing part, and the end surface of the one casing part is in contact with the other casing part.

Specifically, the inner circumference surface 523*a* (the inner pipe surface) of the cover cylinder part 523 (one casing part) is combined by welding to the outer circumference surface 516*a* (the external pipe surface) of the attachment cylinder part 516 (the other casing part). Moreover, the end surface 516*b* of the attachment cylinder part 516 is in contact with the contact surface 523*b* of the cover cylinder part 523. A foreign substance produced, for example, at the assembling time is restricted from entering the housing chamber 520*a* by sealing with the contact surface 523*b*.

According to this embodiment in which the damper attachment 120 is inserted into the attachment component 510, the pulsation damper 500 is produced as a unit separately from the pump body 100. Therefore, compared with the case where a housing chamber is formed in the pump body 100, the size of the pump body 100 can be restricted from becoming large.

(Other Embodiment)

It should be appreciated that the present disclosure is not limited to the embodiments described above and can be modified appropriately within the scope of the appended claims. The embodiments above are not irrelevant to one another and can be combined appropriately unless a combination is obviously impossible.

The attachment component 51, 510 and the cover component 52, 520 are combined by welding in the above embodiments. Alternatively, the attachment component 51, 510 and the cover component 52, 520 may be combined by a fastening member or directly crimping. The attachment component 51, 510 and the damper attachment 12, 120 are combined by screw tightening in the above embodiments. Alternatively, the attachment component 51, 510 and the damper attachment 12, 120 may be combined by welding or crimping. In other words, the pulsation damper 50 may be assembled using a screw to be detachable from the pump body 10, or may be fixed to the pump body 10 by welding in not detachable manner.

The pulsation damper 50 is applied to the fuel pump P in which the control valve 31 is arranged right above the piston 20. The pulsation damper 50 may be applied to a fuel pump in with the control valve 31 is arranged so that the axis of the control valve 31 crosses the axis C1 of the piston 20 (for example, perpendicularly). Alternatively, the pulsation damper 50 may be applied to a fuel pump in which the control valve 31 is arranged so that the axis of the control valve 31 is deviated from the axis C1 of the piston 20.

In each of the embodiments, the pulsation damper 50 is attached to the pump body 10 in a manner that the central line C3 of the diaphragm 53 (the predetermined direction in which the diaphragm 53 is elastically deformed) is in agreement with the central line C2 of the second low-pressure passage L2. Alternatively, the pulsation damper 50 may be attached so that the elastic deformation direction crosses the central line C2. Moreover, the pulsation damper 50 may be attached so that the predetermined direction in which the diaphragm 53 is elastically deformed is in agreement with the central line C4 of the first low-pressure passage L1.

In each of the embodiments, the pulsation damper 50 is attached to the pump body 10 in a manner that the central line C3 of the diaphragm 53 (the predetermined direction in which the diaphragm 53 is elastically deformed) crosses the axis C1 of the piston 20 (for example, perpendicularly). Alternatively, the pulsation damper 50 may be attached to the pump body 10 in a manner that the predetermined direction in which the diaphragm 53 is elastically deformed becomes parallel to the axis C1 of the piston 20.

The forged product is processed to form the pump body 10 in the first embodiment. However, the pump body 10 is not restricted to the forging fabrication. For example, the pump body 10 may be formed by cutting a block-shaped metal material.

In each of the embodiments, the diaphragm 53 is made of metal. Alternatively, the diaphragm may be configured to absorb the fuel pressure pulsation by movement of a divider plate that is arranged to be able to reciprocate in the housing chamber 52*a* due to the elastic force of the divider plate.

The housing chamber 52*a*, 520*a* and the communication passage 51*a*, 510*a* are formed of two components which are the attachment component 51 and the cover component 52 in each of the embodiments. The housing chamber 52*a*, 520*a* and the communication passage 51*a*, 510*a* may be formed of three or more components.

In each of the embodiments, the diameter D1, D2 of the attachment hole 12*d* (damper attachment) is smaller than the diameter D3 of the diaphragm 53. Alternatively, the diameter D1, D2 of a damper attachment may be larger than the diameter D3 of the diaphragm 53, if the diameter D1, D2 of a damper attachment is smaller than the diameter D4 of the housing chamber 52*a*.

In the first embodiment, the seal component 12*r* is located upstream of the contact portion in the permeation course, however, may be arranged downstream of the contact portion. The attachment end surface 511*b* of the attachment 511 is in contact with the contact surface 12*b* of the damper attachment 12 in the embodiment shown in FIG. 2 The attachment end surface 511*b* of the attachment 511 may not be in contact with the damper attachment 12. The end surface 521*b* of the cover cylinder part 521 is in contact with the contact surface 512*a* of the attachment bottom 512 in the embodiment shown in FIG. 2. The end surface 521*b* of the cover cylinder part 521 may not be in contact with the attachment bottom 512.

Figure 2:
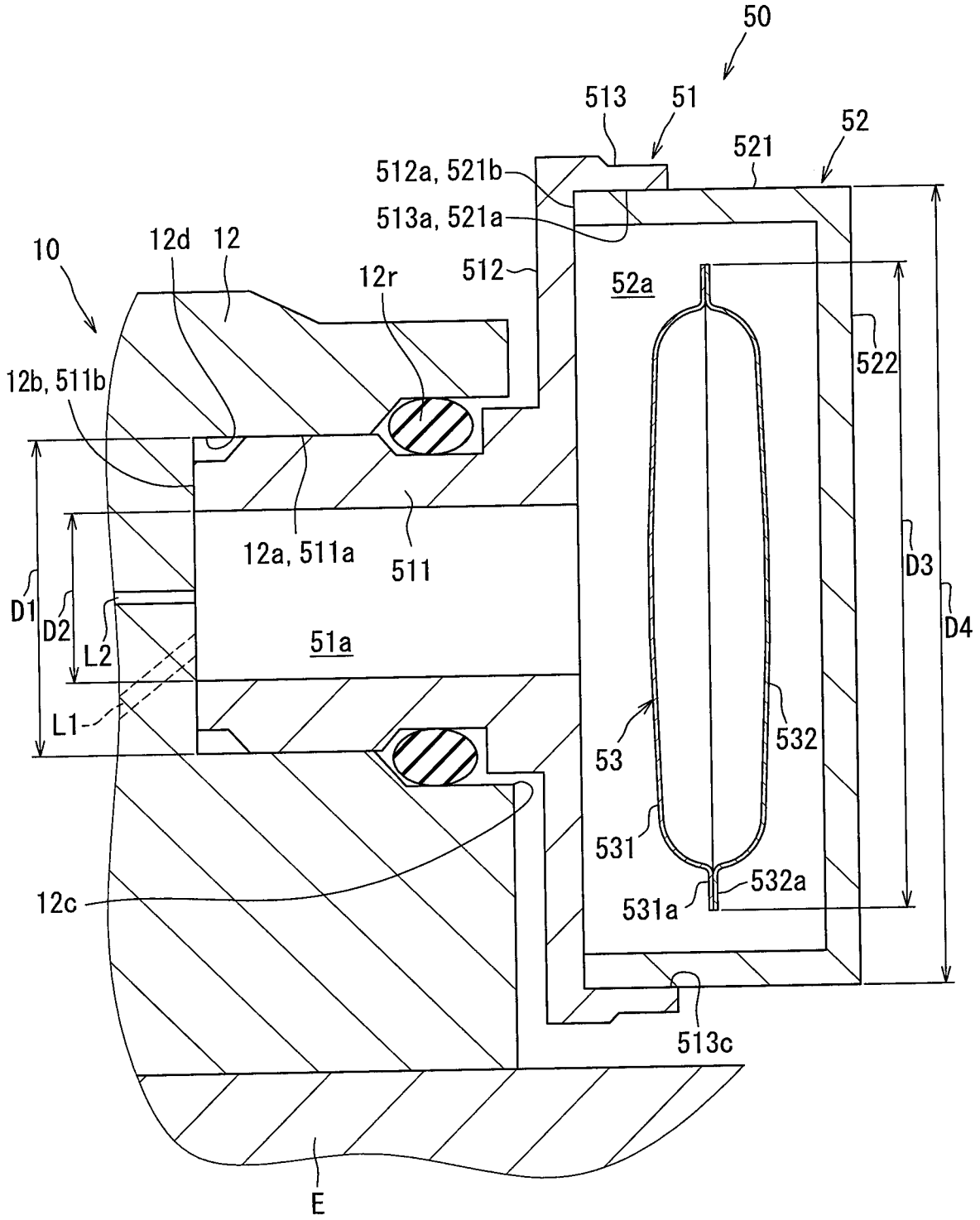
FIG. 2 is an enlarged sectional view of FIG. 1 in which a pulsation damper is attached to a fuel pump.

The diameter D2 of the communication passage 51*a* is larger than the diameter of the first low-pressure passage L1 and the second low-pressure passage L2, in the embodiment shown in FIG. 2. However, the diameter D2 of the communication passage 51*a* may be the same size as the diameter of the first low-pressure passage L1 or the second low-pressure passage L2. In this case, the communication part between one of the first low-pressure passage L1 and the second low-pressure passage L2 and the communication passage 51*a* is located in the end surface of the attachment 511, and the communication part between the other of the first low-pressure passage L1 and the second low-pressure passage L2 and the communication passage 51*a* is located in the circumference surface of the attachment 511.

Such changes and modifications are to be understood as being within the scope of the present disclosure as defined by the appended claims.

What is claimed is:

1. A pulsation damper to reduce pressure pulsation of fuel for a fuel pump, the fuel pump including a pump body and a piston, the pump body defining a fuel passage therein through which the fuel flows, the fuel pump configured to compress the fuel by means of the piston and to discharge the fuel, the pulsation damper comprising:

a diaphragm that is elastically deformed in a predetermined direction by receiving a pressure of fuel, the predetermined direction being perpendicular to an axis of the piston along which the piston moves;

a casing part including a housing chamber that houses the diaphragm; and an attachment to be attached to the pump body, the attachment including a communication passage that makes the housing chamber to communicate with the fuel passage, wherein the attachment has a length in a perpendicular direction perpendicular to the predetermined direction, and the length of the attachment is smaller than a length of the casing part in the perpendicular direction.

2. The pulsation damper according to claim 1, wherein the attachment is made of metal that is different from the pump body, the pulsation damper further comprising:

a seal component that seals a space between the pump body and the attachment, wherein a permeation course is defined, through which water outside of the attachment flows into the space through a contact portion between the pump body and the attachment, and the seal component is arranged upstream of the contact portion in the permeation course.

3. The pulsation damper according to claim 1, wherein the casing part has a first casing part shaped in a pipe and having an opening through which the diaphragm is able to be inserted in the housing chamber, and a second casing part shaped in a based pipe that covers the opening, one of the first casing part and the second casing part has an inner pipe surface combined with an external pipe surface of the other of the first casing part and the second casing part, and the other of the first casing part and the second casing part has an end surface in contact with the one of the first casing part and the second casing part.

4. The pulsation damper according to claim 3, wherein the length of the casing part is a diameter of the external pipe surface of the second casing part.

5. The pulsation damper according to claim 1, wherein the attachment has a pipe form to be inserted in an attachment hole defined in the pump body, and an external pipe surface of the attachment is combined with the pump body, and an end surface of the attachment is in contact with the pump body.

6. The pulsation damper according to claim 5, wherein the length of the attachment is a diameter of the external pipe surface of the attachment.

7. The pulsation damper according to claim 1, wherein the attachment has a pipe form joined with the pump body, and an inner pipe surface of the attachment is combined with the pump body, and an end surface of the attachment is in contact with the pump body.

8. The pulsation damper according to claim 7, wherein the length of the attachment is a diameter of the inner pipe surface of the attachment.

9. The pulsation damper according to claim 1, wherein a diameter of the communication passage is larger than a diameter of a portion of the fuel passage adjacent to the communication passage.

10. The pulsation damper according to claim 1, wherein the attachment has a cylinder shape extending in the predetermined direction, and a radial dimension of a portion of the attachment combined with the pump body is smaller than a diameter of the diaphragm.

11. A fuel pump device comprising:

a fuel pump including a pump body and a piston, the pump body defining a fuel passage therein through which the fuel flows and configured to compress the fuel by means of the piston and to discharge the fuel; and a pulsation damper attached to the pump body to reduce pressure pulsation of fuel, wherein the pulsation damper includes a diaphragm that is elastically deformed in a predetermined direction by receiving a pressure of fuel, a casing part including a housing chamber that houses the diaphragm, and an attachment attached to the pump body and including a communication passage that makes the housing chamber to communicate with the fuel passage, and the attachment has a length in a perpendicular direction perpendicular to the predetermined direction, and the length of the attachment is smaller than a length of the casing part in the perpendicular direction.

12. The fuel pump device according to claim 11, wherein the fuel pump has a piston compressing the fuel flowing into a compression chamber, and a control valve that controls a quantity of fuel to be compressed by opening and closing an inflow port of the compression chamber, the control valve is arranged on an axis of the piston, and the pulsation damper is arranged so that the predetermined direction crosses the axis of the piston.

* * * * *